US009285181B2

(12) United States Patent
Green et al.

(10) Patent No.: US 9,285,181 B2
(45) Date of Patent: Mar. 15, 2016

(54) MOUNTING BLOCK MEMBER FOR AN ARCHERY BOW

(71) Applicant: Daniel A. Summers, Monroe, VA (US)

(72) Inventors: Kenneth P. Green, Lunenburg, VA (US); Kevin Fry, Madison Heights, VA (US); Daniel A. Summers, Monroe, VA (US)

( * ) Notice: Subject to any disclaimer, the term of this patent is extended or adjusted under 35 U.S.C. 154(b) by 0 days.

(21) Appl. No.: 14/600,605

(22) Filed: Jan. 20, 2015

(65) Prior Publication Data

US 2015/0204632 A1 Jul. 23, 2015

Related U.S. Application Data

(60) Provisional application No. 61/928,722, filed on Jan. 17, 2014.

(51) Int. Cl.

| | |
|---|---|
| ***F41B 5/22*** | (2006.01) |
| ***F41B 5/20*** | (2006.01) |
| ***F41B 5/14*** | (2006.01) |
| ***F41G 1/467*** | (2006.01) |

(52) U.S. Cl.

CPC . *F41B 5/143* (2013.01); *F41B 5/14* (2013.01); *F41B 5/1426* (2013.01); *F41G 1/467* (2013.01)

(58) Field of Classification Search

CPC ..... F41B 5/143; F41B 5/1426; F41G 1/467
USPC ..... 124/44.5, 86, 88, 89; 33/265
See application file for complete search history.

(56) References Cited

U.S. PATENT DOCUMENTS

| | | | | | |
|---|---|---|---|---|---|
| 4,548,188 | A * | 10/1985 | Simo | F41B 5/143 | 124/24.1 |
| 4,584,777 | A * | 4/1986 | Saunders | F41G 1/467 | 124/87 |
| 4,788,961 | A * | 12/1988 | Toth | F41G 1/467 | 124/25.5 |
| 4,867,129 | A * | 9/1989 | Scherz | F41B 5/1438 | 124/41.1 |
| 5,117,803 | A * | 6/1992 | Johnson | F41B 5/143 | 124/24.1 |
| 5,394,859 | A * | 3/1995 | Janeway | F41G 1/467 | 124/87 |
| 5,413,084 | A * | 5/1995 | Haggard | F41G 1/467 | 124/44.5 |
| 5,533,494 | A * | 7/1996 | Sacco | F41B 5/143 | 124/24.1 |
| 5,896,849 | A * | 4/1999 | Branthwaite | F41B 5/143 | 124/44.5 |
| 6,612,299 | B2 * | 9/2003 | Martin | F41B 5/14 | 124/86 |
| 6,725,851 | B1 * | 4/2004 | Graf | F41B 5/143 | 124/44.5 |
| 6,823,856 | B2 * | 11/2004 | Rager | F41B 5/143 | 124/44.5 |
| 6,938,616 | B2 * | 9/2005 | Walk | F41B 5/143 | 124/44.5 |
| 7,311,099 | B2 * | 12/2007 | Rager | F41B 5/143 | 124/44.5 |
| 7,409,950 | B2 * | 8/2008 | Ellig | F41B 5/143 | 124/44.5 |
| 7,681,566 | B2 * | 3/2010 | Mertens | F41B 5/143 | 124/44.5 |
| 7,793,645 | B2 * | 9/2010 | Walk | F41B 5/066 | 124/89 |
| 7,913,678 | B2 * | 3/2011 | Hudkins | F41B 5/143 | 124/1 |
| 7,958,881 | B2 * | 6/2011 | Silverson | F41B 5/1426 | 124/86 |
| 8,342,161 | B2 * | 1/2013 | Harwath | F41B 5/143 | 124/41.1 |
| 8,534,273 | B2 * | 9/2013 | LoRocco | F41B 5/1426 | 124/86 |
| 8,544,457 | B1 * | 10/2013 | Munsell | F41B 5/143 | 124/44.5 |
| 8,701,643 | B2 * | 4/2014 | Ellig | F41B 5/1438 | 124/44.5 |
| 8,752,536 | B2 * | 6/2014 | Sims | F41B 5/10 | 124/24.1 |
| 8,925,536 | B2 * | 1/2015 | Derus | F41B 5/1403 | 124/25.6 |
| 2003/0188731 | A1 * | 10/2003 | Ho | F41B 11/52 | 124/56 |

* cited by examiner

*Primary Examiner* — Alexander Niconovich
(74) *Attorney, Agent, or Firm* — Barclay Damon, LLP

(57) ABSTRACT

This disclosure describes embodiments of a mounting block member for an archery bow that dampens vibrations. The mounting block member comprises a cover member that dampens vibrations.

21 Claims, 20 Drawing Sheets

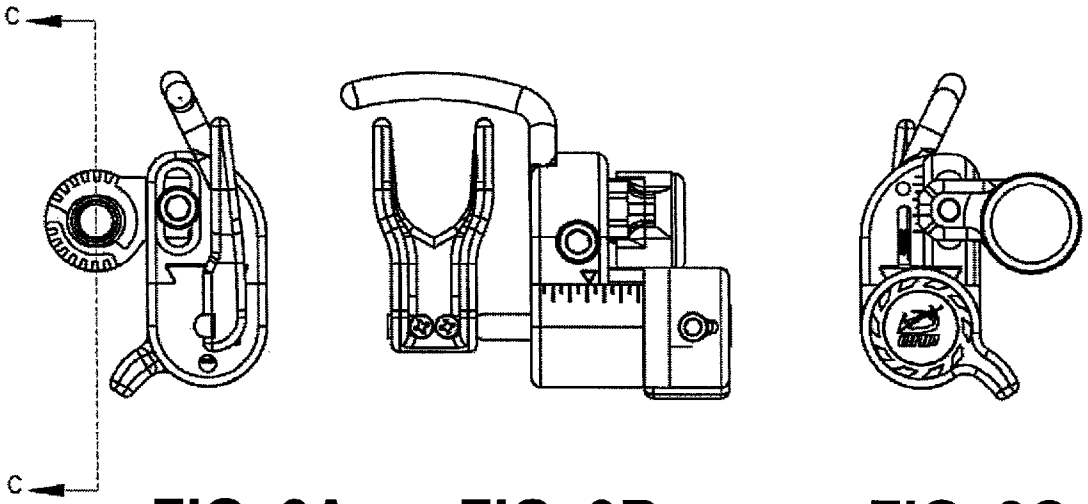
FIG. 9A
FIG. 9B
FIG. 9C
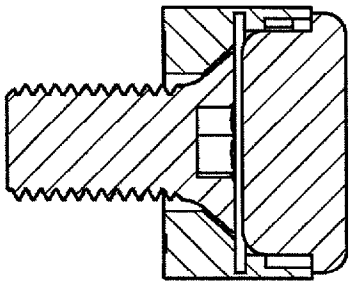
FIG. 9D

FIG. 16A
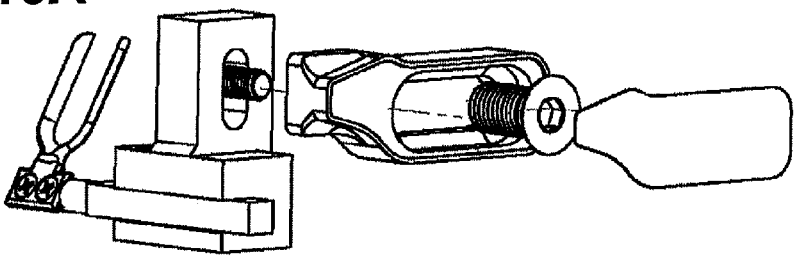
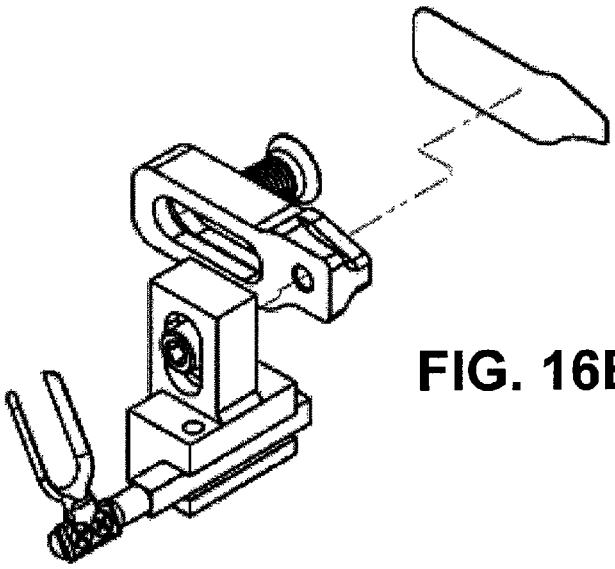
FIG. 16B
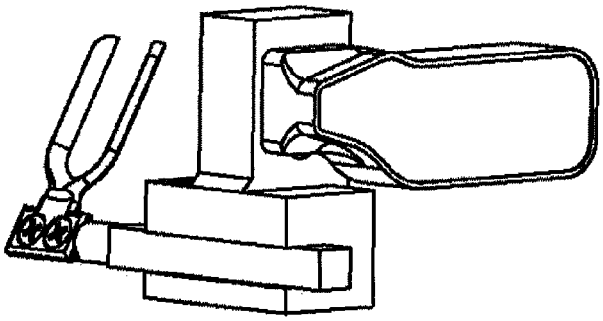
FIG. 16C

FIG. 17A
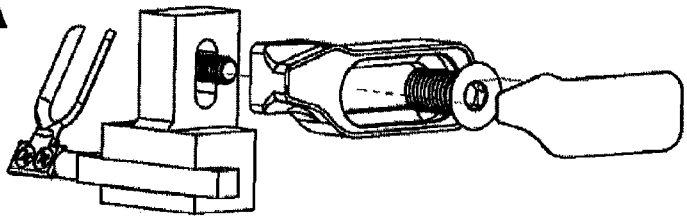
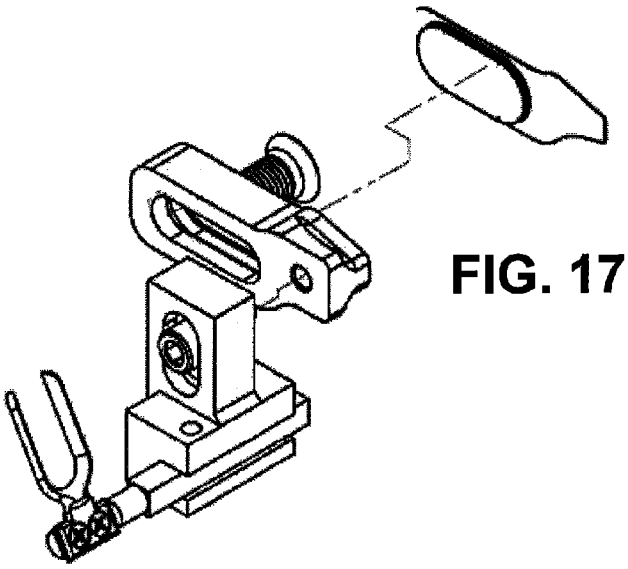
FIG. 17B
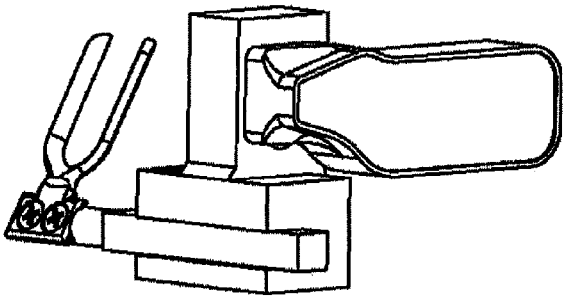
FIG. 17C

FIG. 18A
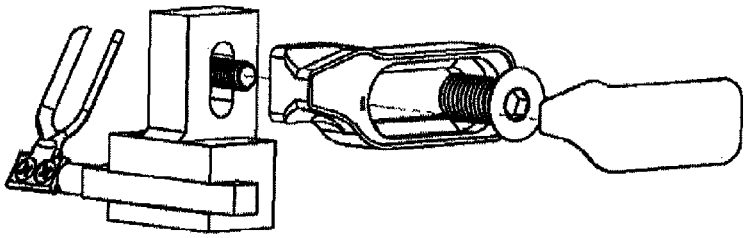
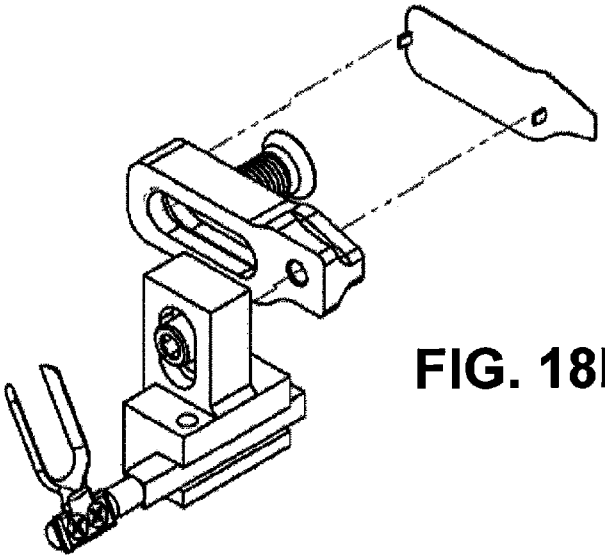
FIG. 18B
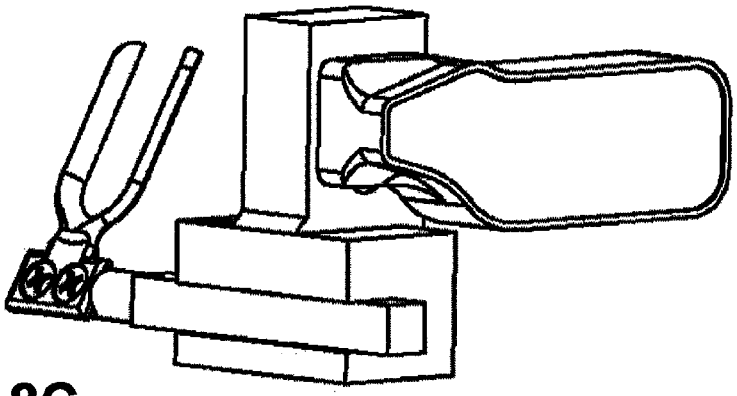
FIG. 18C

FIG. 19A
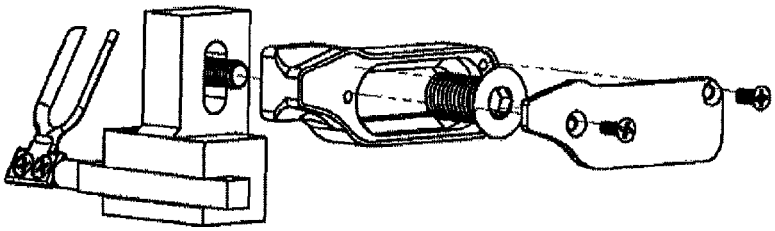
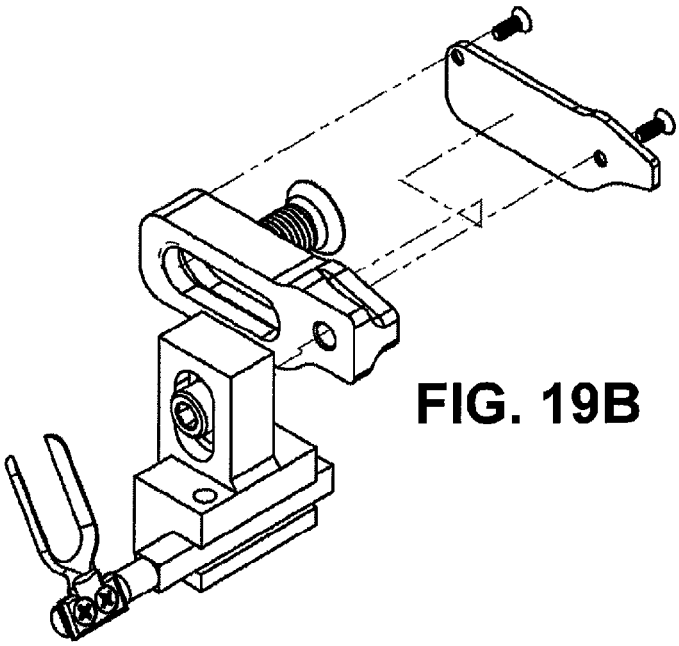
FIG. 19B
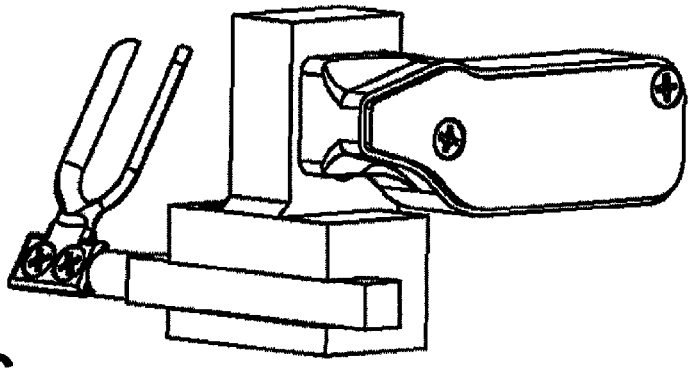
FIG. 19C

MOUNTING BLOCK MEMBER FOR AN ARCHERY BOW

CROSS-REFERENCE TO RELATED APPLICATIONS

This application claims priority to and is a non-provisional of U.S. Patent Application Ser. No. 61/928,722 (filed Jan. 17, 2014) the entirety of which is incorporated herein by reference.

BACKGROUND OF THE INVENTION

The subject matter disclosed herein relates to archery technology, with particular discussion about configurations for a mounting block member that dampens vibrations.

Arrow rests are well-known for use on archery bows to stabilize an arrow in position for an end user to release an arrow toward a target. In conventional configurations, the arrow rest secures to the archery bow, most often proximate the handle on the riser. These configurations often use one or more fasteners (e.g., a screw or a bolt) that penetrate through a part of the arrow rest. The fastener typically engages complimentary threads on the riser.

During use, the release of the arrow results in vibrations from the bowstring being transmitted throughout the bow riser. These vibrations can alter the trajectory of the arrow, disrupt sights and other devices that are attached to the riser, and/or cause noise that may be detected by game. Many styles of arrow rests (e.g. whisker biscuits, fall-aways, etc.) experience these vibrations. An improved arrow rest is therefore desired.

The discussion above is merely provided for general background information and is not intended to be used as an aid in determining the scope of the claimed subject matter.

BRIEF DESCRIPTION OF THE INVENTION

This disclosure describes embodiments of an archery rest assembly that dampens vibrations. The archery rest assembly comprises a cover member on a mounting block member that dampens vibrations.

In a first embodiment, a mounting block member for an archery bow is provided. The mounting block member comprises a mounting block member comprising a first aperture; a cover member disposed over the first aperture such that the first aperture is covered; and a first fastener disposed within the first aperture, the first fastener for connecting the mounting block member to a riser of a bow.

In a second embodiment, an archery bow is provided The archery bow comprises a bow riser; a mounting block member comprising a first slotted aperture inset within a recessed feature; a cover member disposed within the recessed feature such that the first slotted aperture is covered and the cover member contacts an entire perimeter of the recessed feature; and a first fastener disposed within the first slotted aperture, the first fastener for connecting the mounting block member to the bow riser.

In a third embodiment, a fall-away archery rest assembly is provided. The fall-away archery rest comprises a housing pivotably connected to an arrow rest member about a pivot, the arrow rest member comprising an arrow receptacle defined by a pair of elongated arms; a mounting block member connected to the housing, the mounting block member comprising a first slotted aperture inset within a recessed feature; a cover member disposed within the recessed feature such that the first slotted aperture is covered; and a first fastener disposed within the first slotted aperture, the first fastener for connecting the mounting block member to a riser of a bow.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which:

Reference is now made briefly to the accompanying drawings, in which:

FIG. 9A to 9D depict various views of an exemplary archery rest assembly with a circular cover member;

FIG. 16A to FIG. 16C depict an archery rest member with an exemplary cover member of FIG. 13;

FIG. 17A to FIG. 17C depict an archery rest member with an exemplary cover member of FIG. 13;

FIG. 18A to FIG. 18C depict an archery rest member with an exemplary cover member of FIG. 13;

FIG. 19A to FIG. 19C depict an archery rest member with an exemplary cover member of FIG. 13;

Where applicable like reference characters designate identical or corresponding components and units throughout the several views, which are not to scale unless otherwise indicated.

DETAILED DESCRIPTION OF THE INVENTION

Figure 1:
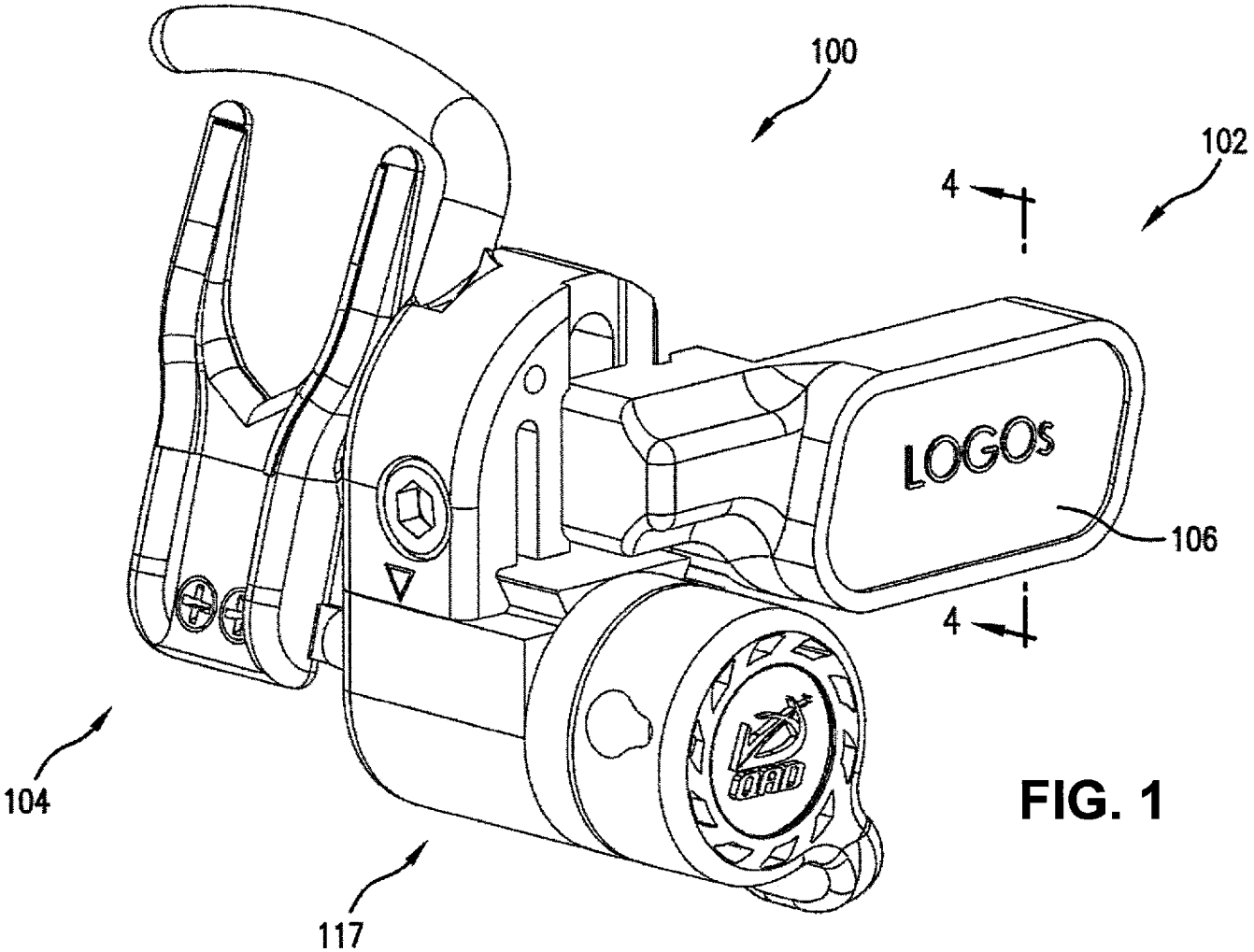
FIG. 1 depicts a perspective view of an exemplary embodiment of an archery rest assembly.
Figure 2:
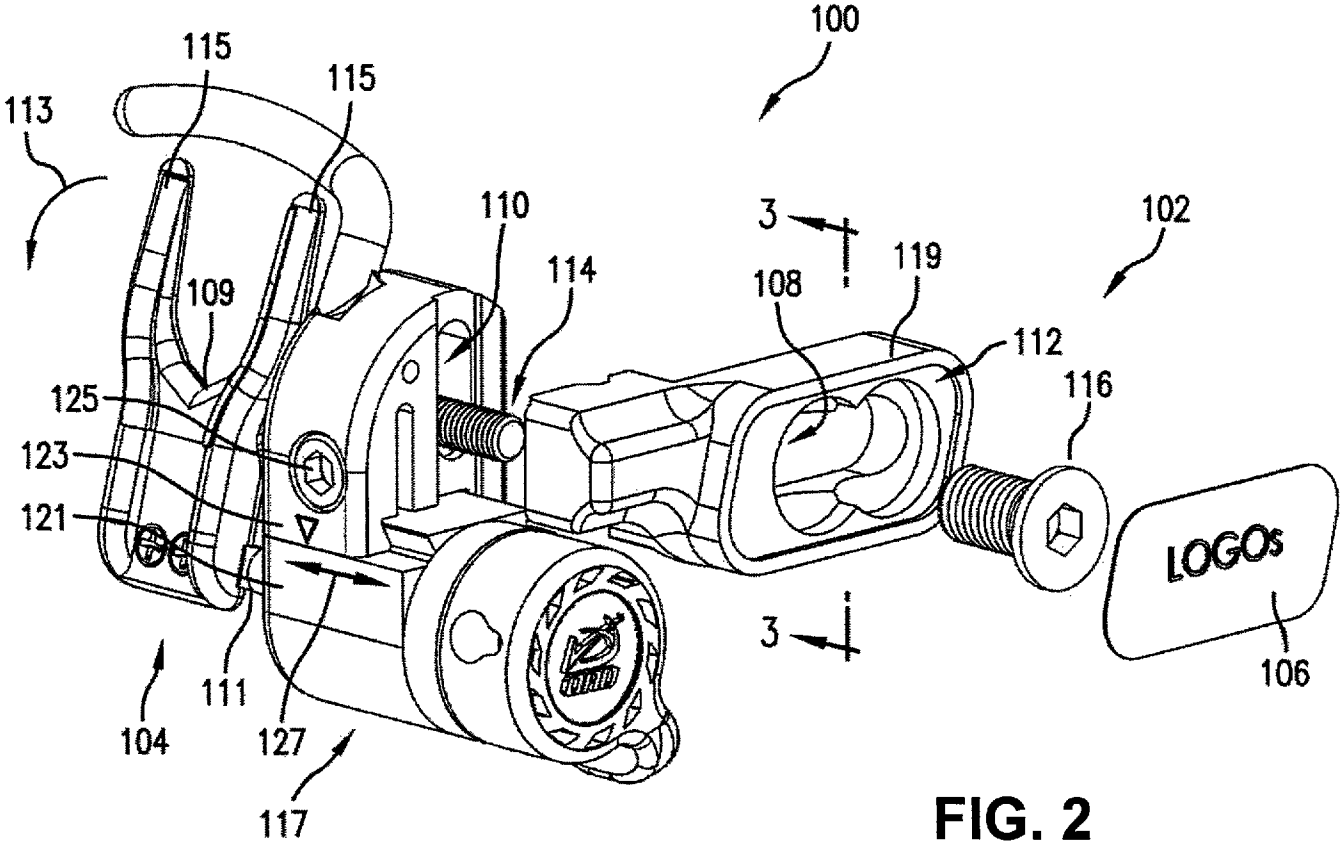
FIG. 2 depicts a perspective view of the archery rest assembly of FIG. 1 in exploded form.

FIG. 1 and FIG. 2 illustrate a perspective view of an exemplary embodiment of an arrow rest assembly 100 in assembled form (FIG. 1) and exploded form (FIG. 2). Although the examples depicted in the figures show fall-away arrow rest assemblies, one skilled in the art would recognize such arrow rest assemblies are also applicable to other types of arrow rest assemblies. As shown in FIG. 1, the illustrated embodiment includes several components (e.g., a housing 117, a mounting block member 102, an arrow rest member 104, and a cover member 106). These components mount the assembly 100 to an archery bow and support a projectile (e.g., arrow) that an end user will release towards a target. As noted herein, and in additional detail below, one configuration of the components can remove certain features of the assembly 100 from view, thereby improving appearance, reducing contamination, and preventing tampering with the assembly 100 when in position on the archery bow.

The release of an arrow from an arrow rest results in vibrations being transmitted through the riser of the bow. These vibrations can alter the trajectory of the arrow, disrupt sights and other devices that are attached to the riser, and/or cause noise that may be detected by game. Without necessarily being bound to any particular theory, the cover member is believed to act as a dampener that reduces these vibrations.

In the example of FIG. 2, the projectile is supported by an arrow receptacle 109 of the arrow rest assembly 100 until such time as the end user releases the projectile from the archery bow. The arrow receptacle 109 is defined by a pair of arms 115 that are spaced apart from one another. The arrow rest member 104 rotates about a pivot 111 in a forward direction 113 such that the arrow receptacle 109 does not contact vanes on a rear portion of the projectile.

The illustration of FIG. 2 shows that the mounting block member 102 and the housing 117 each incorporate slotted apertures (e.g., a first slotted aperture 108 and a second slotted aperture 110). The slotted apertures are elongated such that the end user can adjust fasteners at a variety of positions. The mounting block member 102 also has a recessed feature 112 with dimensions (e.g., length, width, depth, etc.) to receive the cover member 106. FIG. 2 also shows that the arrow rest assembly 100 can have one or more fasteners (e.g., a first fastener 116 and a second fastener 114), each one disposed in the slotted apertures 108, 110, respectively. In one example, the second fastener 114 extends through the second slotted aperture 110 on the housing 117 to engage a corresponding feature (e.g., a threaded hole, heli-coil, insert, nut, etc.) on the mounting block member 102. This configuration secures the arrow rest member 104 to the housing 117. The first fastener 116 extends through the first slotted aperture 108 on the mounting block member 102. When the arrow rest assembly 100 is assembled on an archery bow, the first fastener 116 mates with a corresponding feature, e.g., on the bow riser, to locate the arrow rest member 104 in position to receive a projectile. The first slotted aperture 108 and the second slotted aperture 110 may permit an end user to adjust the lateral position and the vertical position of the arrow rest assembly 100 on the riser of a bow to alter the weight distribution of the arrow rest assembly 100 while mounted to a particular bow. This enhances the ability of the arrow rest assembly 100 to act as a dampener and further permits customization for different bows.

In one embodiment, the recessed feature 112 comprises at least two recesses 119 with a predetermined shape that receive the first fastener 116 with a corresponding predetermined shape head. For example, the predetermined shape may be circular. Such a configuration permits the end user to select a desired lateral position for the first fastener 116 from a plurality of predetermined lateral positions—one such position for each circular head. Without necessarily being bound by any particular theory, the plurality of circular recesses 119 coupled with the first slotted aperture 108 may permit an end user to adjust the lateral position of the arrow rest assembly 100 on the riser of a bow while acting as a dampener. The mating of the two predetermined shapes provides a secure connection that reduces vibrations while still permitting the end user to laterally adjust the first fastener 116.

In the embodiment of FIG. 2, the housing 117 is separated into a first portion 121 and a second portion 123. A fastener 125 (e.g. a hex bolt) secures or releases the first portion 121 from the second portion 123. The first portion 121 comprises the second slotted aperture 110 and is therefore fixedly connected relative to the mounting block member 102. When released, the second portion 123 slides along direction 127 and permits the end user to adjust a lateral portion of the arrow rest member 104 by laterally adjusting the position of the pivot 111.

Figure 3:
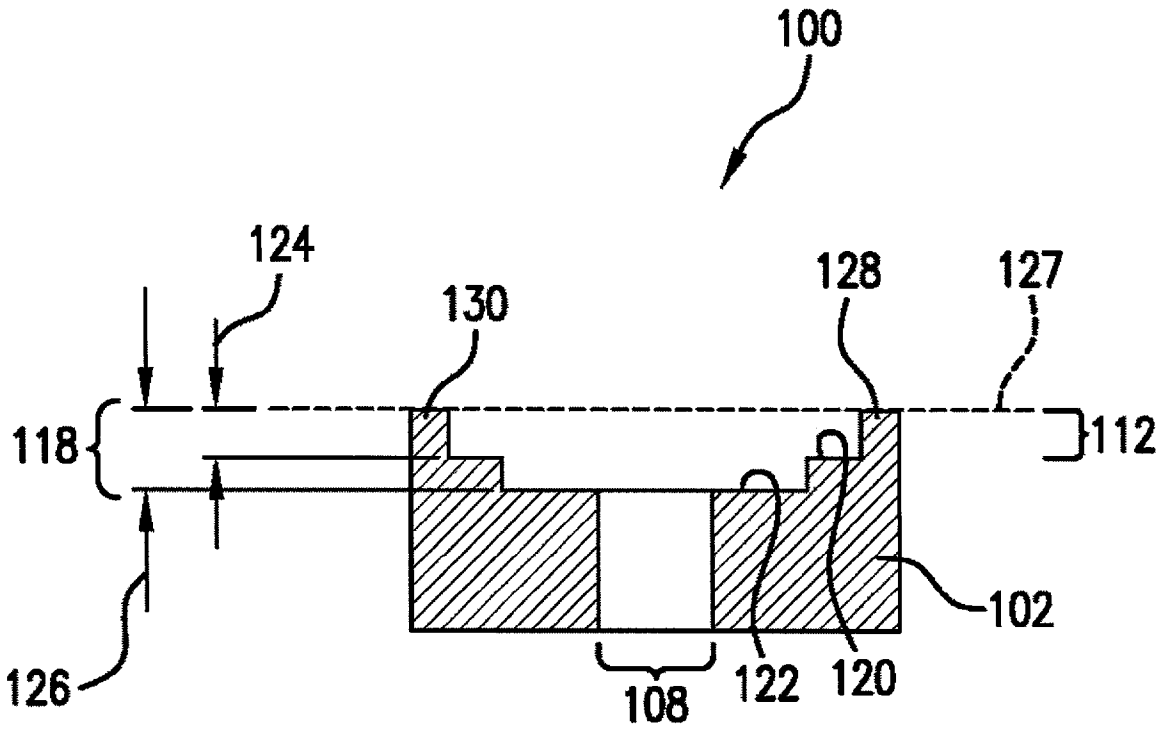
FIG. 3 depicts a cross-section view of an example of a mounting block member found in the archery rest assembly of FIGS. 1 and 2.

FIG. 3 depicts a cross-section view of the arrow rest assembly 100 at line 3-3 of FIG. 2. The mounting block member 102 has a stepped profile 118 that incorporates the first slotted aperture 108 and the recessed feature 112. The stepped profile 118 defines several surfaces (e.g., a first surface 120 and a second surface 122). These surfaces are disposed at, respectively, a first depth 124 and a second depth 126 as measured from a plane 127 that is tangent to one or more points (e.g., first point 128 and second point 130) on the exposed surface of the mounting block member 102. As shown in FIG. 3, the points 128, 130 may reside on opposites sides of the recessed feature 112. In one example, the plane 127 is generally parallel with one or more of the surfaces 120, 122.

Figure 4:
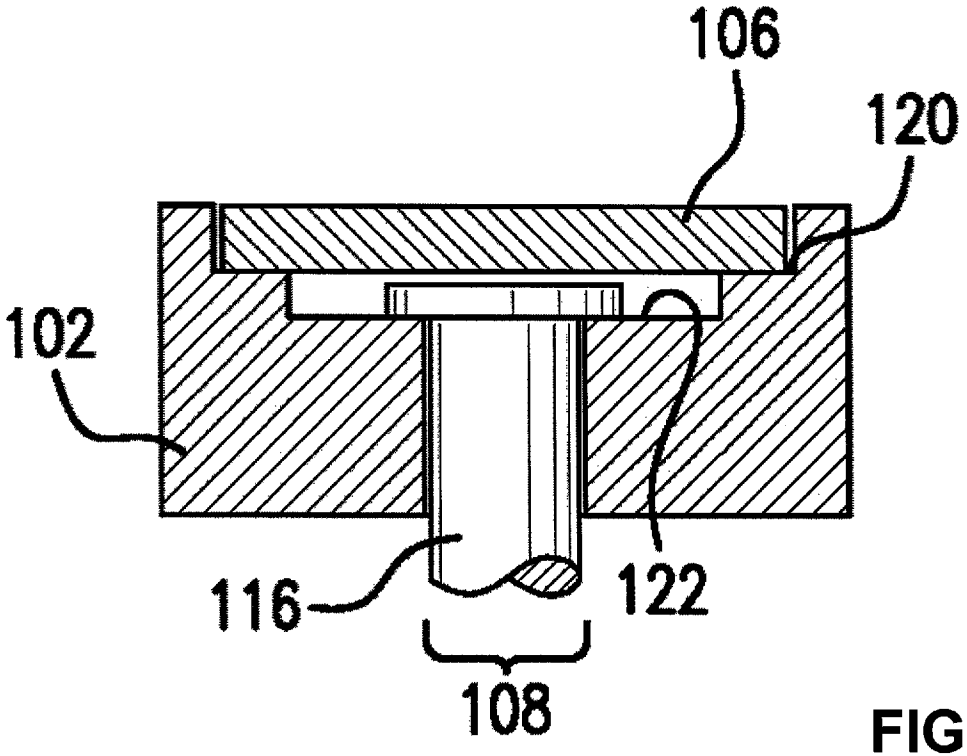
FIG. 4 depicts a cross-section view of an example of a mounting block member found in the archery rest assembly of FIGS. 1 and 2.

FIG. 4 depicts a cross-section view of the mounting block member 102 of FIG. 1 at line 4-4. Because the mounting block member 102 is directly connected to the bow riser by the first fastener 116, vibrations in the bow riser are transmitted to the mounting block member 102. Without necessarily being bound to any particular theory, a perimeter of the cover member 106 is disposed within the recessed feature of the mounting block member 102 such that the perimeter contacts edge walls of the recessed feature 112 to provide a brace. This further reduces vibrations relative to a mounting block member that lacks such a cover member. As shown in FIG. 4, the first fastener 116 contacts the second surface 122. The cover member 106 is in position in the recessed feature 112, in contact with the first surface 120. In one example, the arrow rest assembly 100 may include adhesive and/or other material that secures the cover member 106 to the mounting block member 102. This adhesive may form a material layer about the periphery of the cover member 106 to adhere the cover member 106 to the first surface 120.

Figure 5:
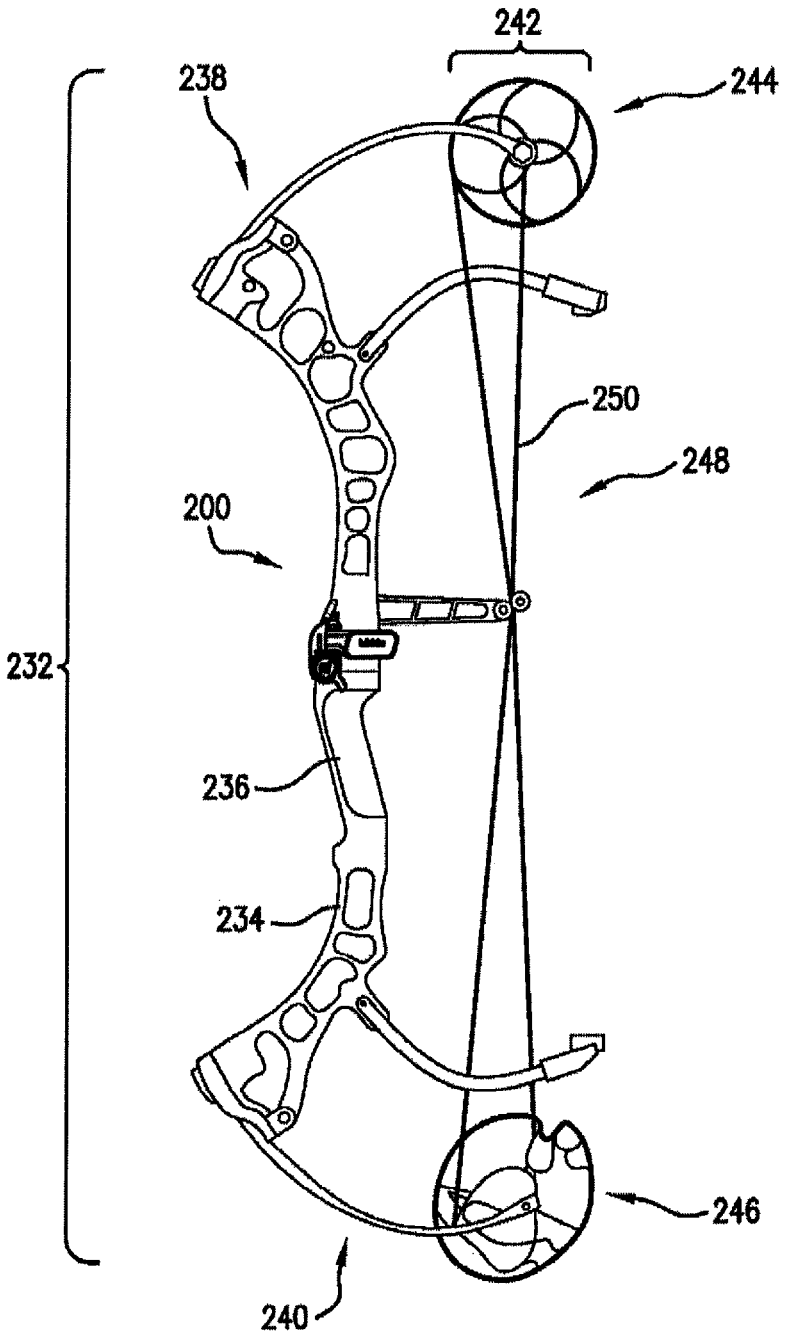
FIG. 5 depicts schematic diagram of an exemplary archery rest assembly mounted to an example of an archery bow.

FIG. 5 depicts a schematic diagram to illustrate, generally, use of an exemplary embodiment of an archery rest assembly 200 on an example of an archery bow 232. The example includes a riser 234 with a handle 236. On either end of the riser 234, the archery bow 232 includes a limb element (e.g., a first limb element 238 and a second limb element 240) that support a cam assembly 242. Examples of the cam assembly 242 can include one or more cam members (e.g., a first cam member 244 and a second cam member 246) that couple with the limb elements 238, 240. The archery bow 232 can also include a bowstring assembly 248 with one or more bowstrings 250 that extend between and/or couple with the cam members 244, 246.

Figure 6A:
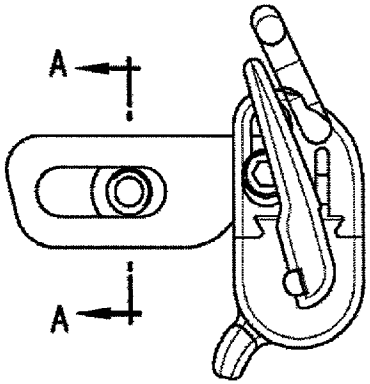
FIGS. 6A to 6F depict various views of an exemplary archery rest assembly with a rectangular cover member.
Figure 6B:
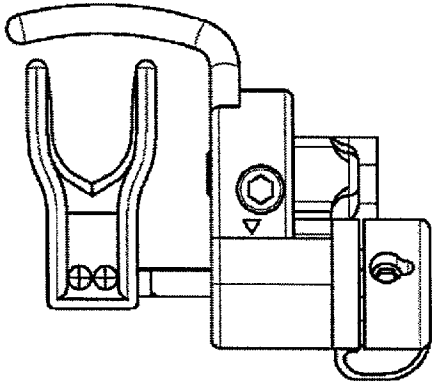
Figure 6C:
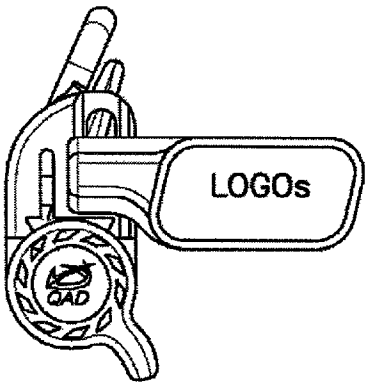
Figure 6D:
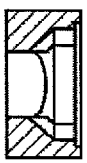
Figure 6E:
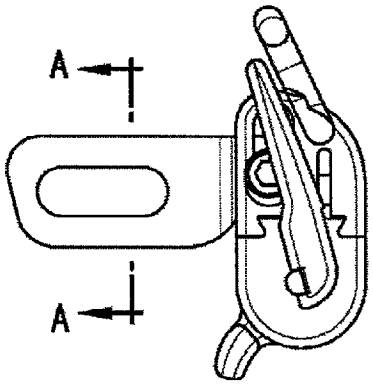
Figure 6F:
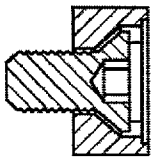

FIG. 6A to FIG. 6F depict various views of an exemplary archery rest assembly. FIG. 6A is a left side view of an archery rest assembly that comprises a first fastener. FIG. 6B is a front view of the archery rest assembly. FIG. 6C is a right side view of the archery rest assembly. The cover member of FIG. 6C is rectangular with rounded corners. In some embodiments, the cover member may have a company logo on an external surface. FIG. 6D is a cross section along line A-A of FIG. 6A showing the first fastener in place. FIG. 6E is a left side view of an archery rest assembly that omits the first fastener. FIG. 6F is a cross section along line A-A of FIG. 6E showing a stepped contour of a recessed feature.

Figure 7C:
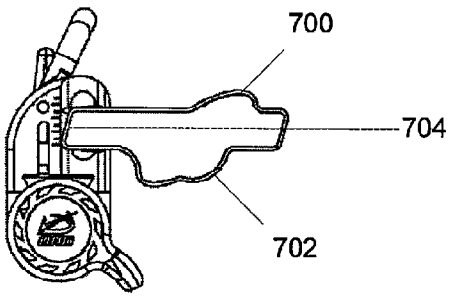
FIG. 7A to 7D depict various views of an exemplary archery rest assembly with a contoured cover member.
Figure 7B:
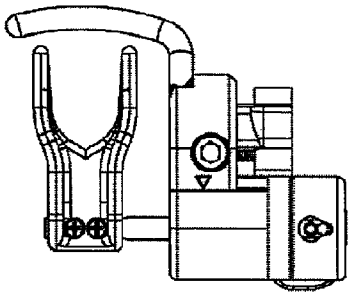
Figure 7A:
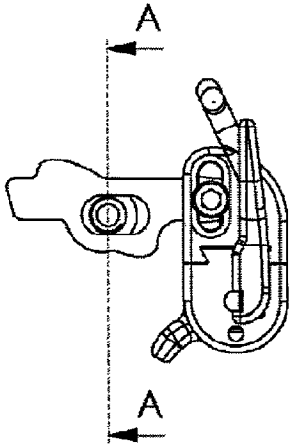
Figure 7D:
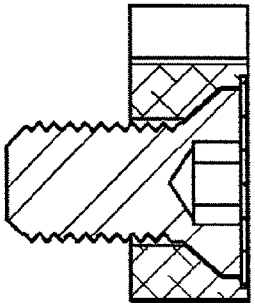

FIG. 7A to FIG. 7D depict various views of another exemplary archery rest assembly. FIG. 7A is a left side view of an archery rest assembly that comprises a first fastener. FIG. 7B is a front view of the archery rest assembly. FIG. 7C is a right side view of the archery rest assembly. The cover member of FIG. 7C is elongated with contoured perimeters that include as lead on curve 700 extending upward from a longitudinal axis 704 and at least one curve 702 extending downward from the longitudinal axis 704. In some embodiments, the cover member may have a company logo on an external surface and the curves may be shaped to permit the logo to fit on the cover member. FIG. 7D is a cross section along line A-A of FIG. 7A showing the first fastener in place.

Figure 8C:
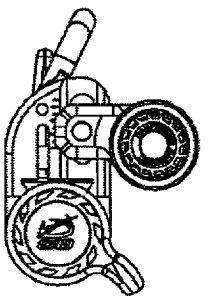
FIG. 8A to 8D depict various views of an exemplary archery rest assembly with a circular cover member.
Figure 8B:
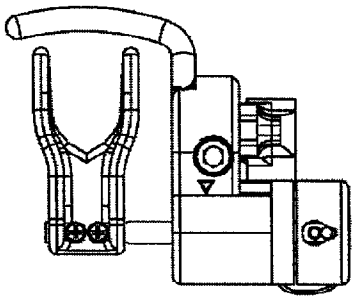
Figure 8A:
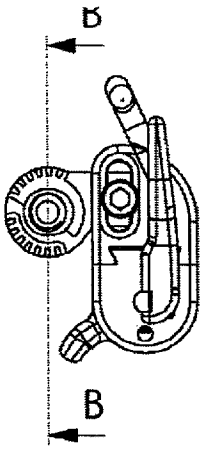
Figure 8D:
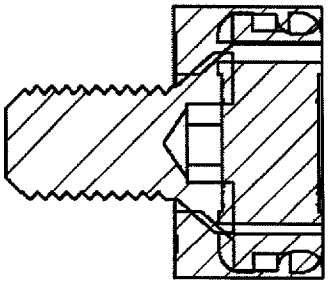

FIG. 8A to FIG. 8D depict various views of another exemplary archery rest assembly. FIG. 8A is a left side view of an archery rest assembly that comprises a first fastener. FIG. 8B is a front view of the archery rest assembly. FIG. 8C is a right side view of the archery rest assembly. The cover member of FIG. 8C is circular with a textured surface. The textured surface permits the end user to screw a threaded cover member onto the mounting block member by hand. FIG. 8D is a cross section along line B-B of FIG. 8A showing the first fastener in place.

FIG. 9A to FIG. 9D depict various views of another exemplary archery rest assembly. FIG. 9A is a left side view of an archery rest assembly that comprises a first fastener. FIG. 9B is a front view of the archery rest assembly. FIG. 9C is a right side view of the archery rest assembly. The cover member of FIG. 9C is circular with a smooth, flat surface. FIG. 9D is a cross section along line C-C of FIG. 9A showing the first fastener in place.

Figure 10C:
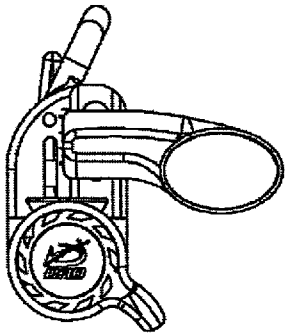
FIG. 10A to 10D depict various views of an exemplary archery rest assembly with an elliptical cover member.
Figure 10B:
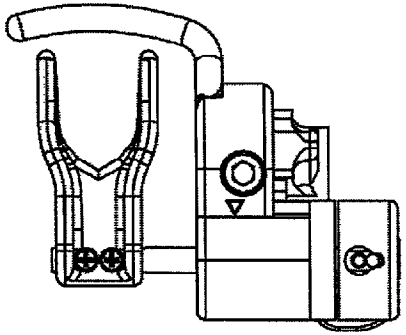
Figure 10A:
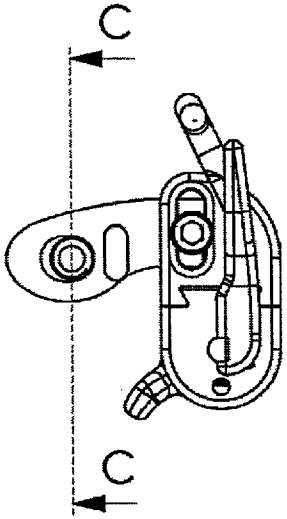
Figure 10D:
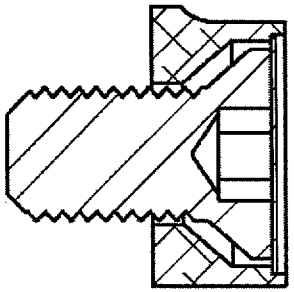

FIG. 10A to FIG. 1 OD depict various views of another exemplary archery rest assembly. FIG. 10A is a left side view of an archery rest assembly that comprises a first fastener. FIG. 10B is a front view of the archery rest assembly. FIG. 10C is a right side view of the archery rest assembly. The cover member of FIG. 10C is an ellipse. FIG. 10D is a cross section along line C-C of FIG. 10A showing the first fastener in place.

Figure 11C:
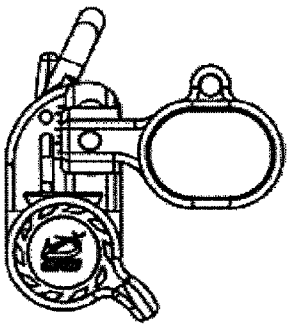
FIG. 11A to 11D depict various views of an exemplary archery rest assembly with a rectangular cover member.
Figure 11B:
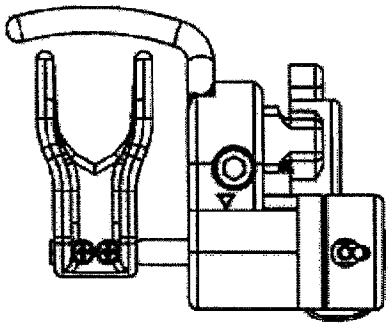
Figure 11A:
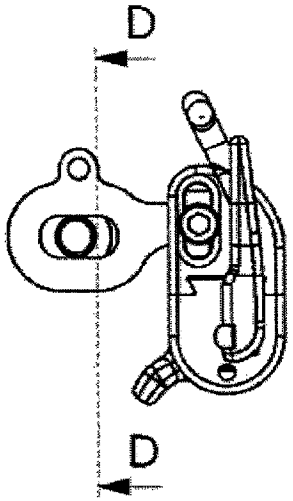
Figure 11D:
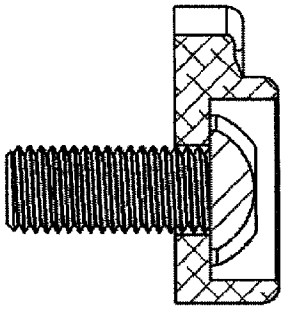

FIG. 11A to FIG. 11D depict various views of an exemplary archery rest assembly. FIG. 11A is a left side view of an archery rest assembly that comprises a first fastener. FIG. 11B is a front view of the archery rest assembly. FIG. 11C is a right side view of the archery rest assembly. The cover member of FIG. 11C is rectangular with rounded corners, although the rectangle is shorter than the embodiment of FIG. 6C. FIG. 11D is a cross section along line D-D of FIG. 11A showing the first fastener in place.

Figure 12C:
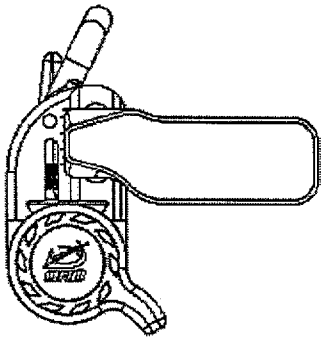
FIG. 12A to 12D depict various views of an exemplary archery rest assembly with a rectangular cover member.
Figure 12B:
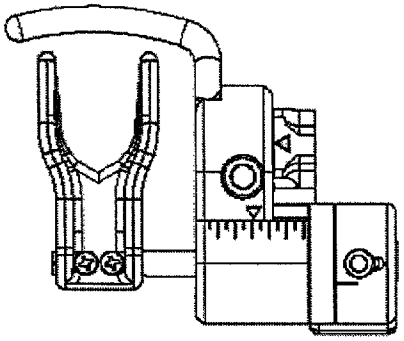
Figure 12A:
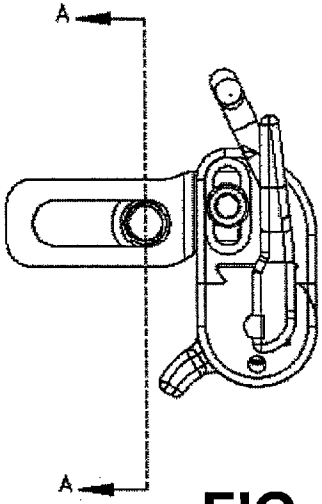
Figure 12D:
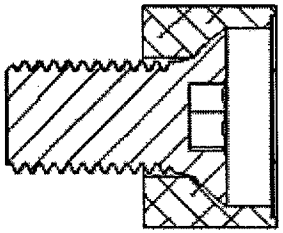

FIG. 12A to FIG. 12D depict various views of an exemplary archery rest assembly. FIG. 12A is a left side view of an archery rest assembly that comprises a first fastener. FIG. 12B is a front view of the archery rest assembly. FIG. 12C is a right side view of the archery rest assembly. The cover member of FIG. 12C is rectangular with rounded corners, although the rectangle is shorter than the embodiment of FIG. 6C and has a different contoured perimeter than the embodiment of FIG. 11C. FIG. 12D is a cross section along line A-A of FIG. 12A showing the first fastener in place.

Figure 13:
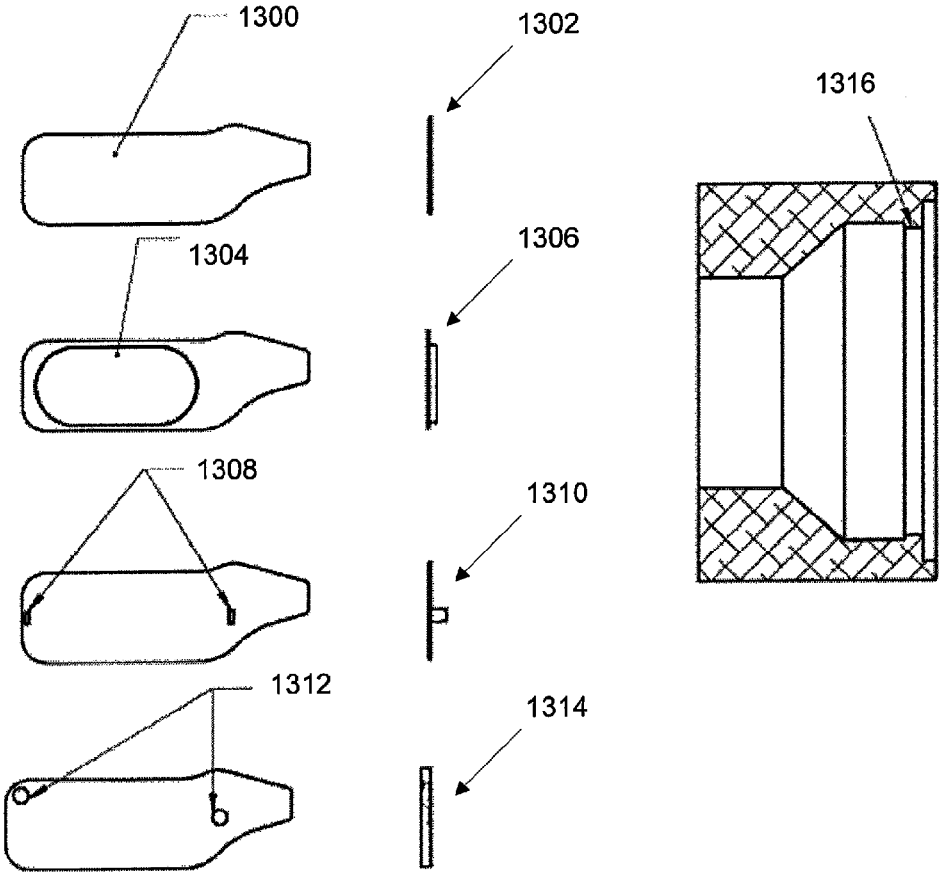
FIG. 13 depicts exemplary cover members and their respective profiles.

FIG. 13 depicts exemplary cover members and their respective profiles. Cover member 1300 secures to the mounting block member with adhesive such that its profile 1302 is flat. Cover member 1304 comprises a raised lip that mates with a corresponding lip on the mounting block member. The raised slip of cover member 1304 is depicted in profile 1306. Cover member 1308 comprises extruded tabs that mate with corresponding recesses on the mounting block member. The extruded tabs are depicted in profile 1310. Cover member 1312 comprises holes that permits the cover member 1308 to attach to the mounting block member with flat-headed fasteners. The profile 1314 shows the holes in dotted line format. In each embodiment, the cover member is held in place by a lip 1316 of the mounting block member. Other suitable options of attaching the cover member would be apparent to one skilled in the art after benefiting from reading this specification. Such options include, hook-and-loop fasteners (e.g. VELCRO™) magnetic fasteners, radiator-cap-style fasteners, and the like.

Figures 14A, 14B, 14C, 14D, 15A, 15B, 15C, 15D:
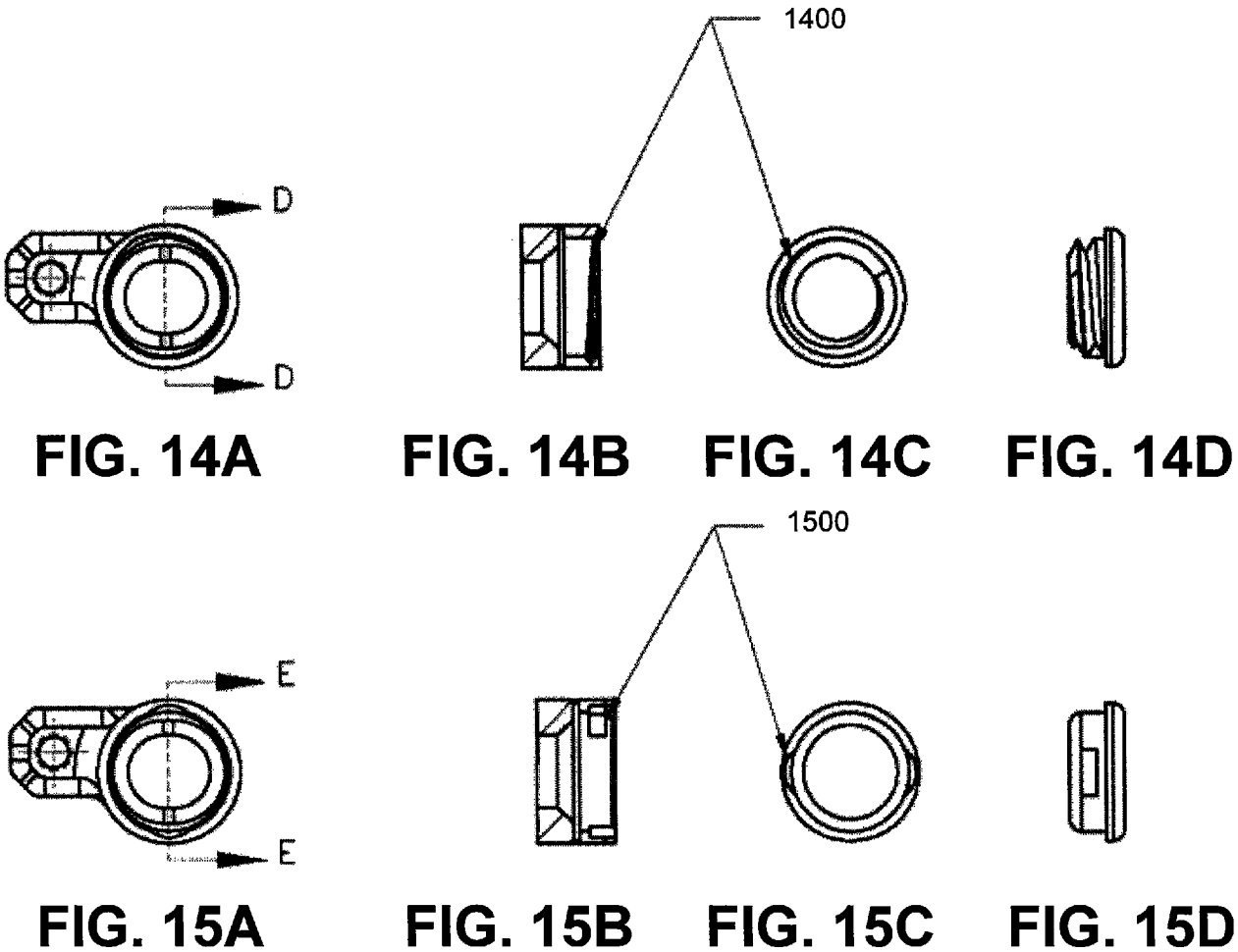
FIG. 14A to FIG. 14D depict an exemplary cover member with threads that mate with corresponding threads on the mounting block member.
FIG. 15A to FIG. 15D depict an exemplary cover member with flexible protrusions that mate with corresponding recesses on the mounting block member.

FIG. 14A to FIG. 14D depict an exemplary cover member with threads 1400 that mate with corresponding threads on the mounting block member. FIG. 14A depicts a bottom of the cover member. FIG. 14B is a cross section along line D-D of FIG. 14A. FIG. 14C is a bottom view of the threads 1400 while FIG. 14D is a profile view of the same.

FIG. 15A to FIG. 15D depict an exemplary cover member with flexible protrusions 1500 that mate with corresponding recesses on the mounting block member. FIG. 15A depicts a bottom of the cover member. FIG. 15B is a cross section along line E-E of FIG. 11A. FIG. 15C is a bottom view of the flexible protrusions 1500 while FIG. 15D is a profile view of the same.

FIG. 16A to FIG. 16C depict an archery rest member with the cover member 1300, wherein FIG. 16A and FIG. 16B are exploded views and FIG. 16C is an assembled perspective view showing the cover member 1300.

FIG. 17A to FIG. 17C depict an archery rest member with the cover member 1304, wherein FIG. 17A and FIG. 17B are exploded views and FIG. 17C is an assembled perspective view showing the cover member 1304.

FIG. 18A to FIG. 18C depict an archery rest member with the cover member 1308, wherein FIG. 18A and FIG. 18B are exploded views and FIG. 18C is an assembled perspective view showing the cover member 1308.

FIG. 19A to FIG. 19C depict an archery rest member with the cover member 1312, wherein FIG. 19A and FIG. 19B are exploded views and FIG. 19C is an assembled perspective view showing the cover member 1312.

Figure 20A:
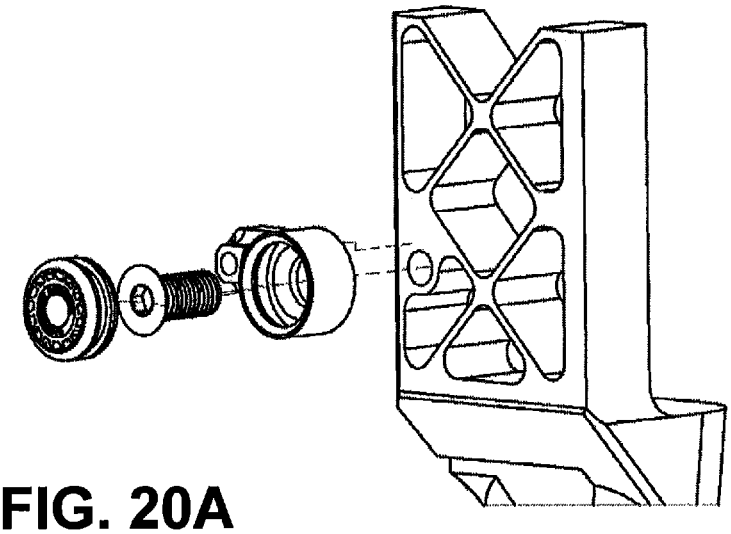
FIGS. 20A and 20B depict an exemplary mounting block member with a circular cover member.
Figure 20B:
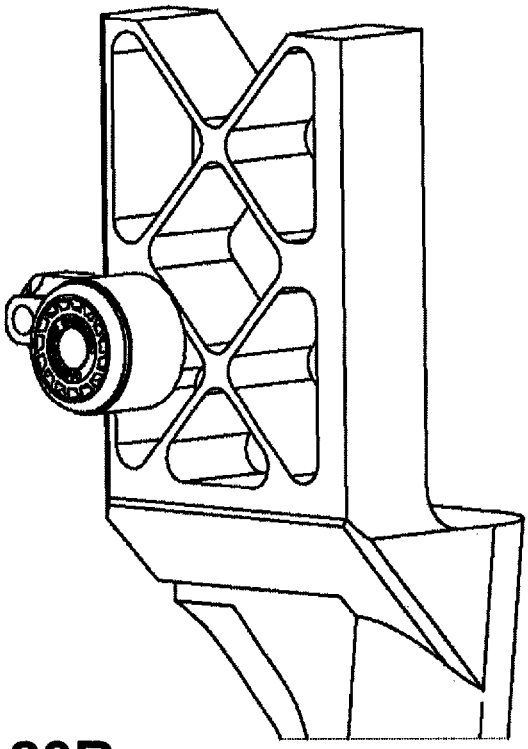

FIGS. 20A and 20B depict a mounting block member with a circular cover member. The exemplary mounting block member omits an archery rest member. FIG. 20A provides an exploded view while FIG. 20B provides an assembled perspective view.

Figure 21A:
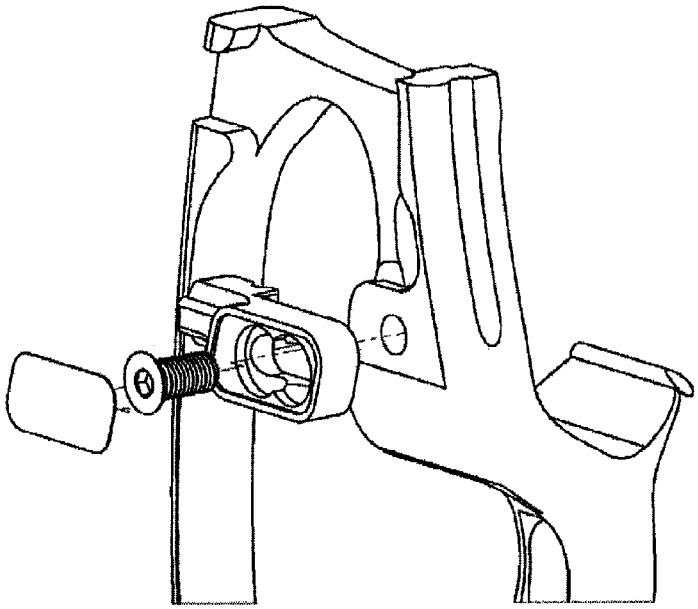
FIGS. 21A and 21B depict a mounting block member with a rectangular cover member.
Figure 21B:
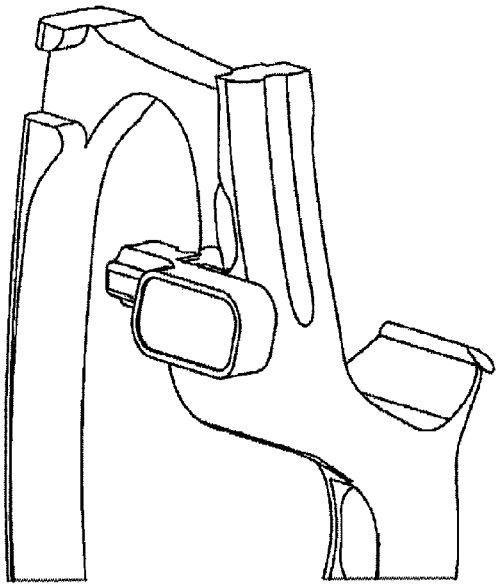

FIGS. 21A and 21B depict a mounting block member with a rectangular cover member. The exemplary mounting block member omits an archery rest member. FIG. 21A provides an exploded view while FIG. 21B provides an assembled perspective view.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A mounting block member for an archery bow, the mounting block member comprising:

a step-shaped structure defining an aperture configured to receive a fastener, the step-shaped structure comprising:

a bottom surface configured to face in a mounting direction toward an archery bow;

a top surface;

a first inner wall extending from the top surface in the mounting direction;

a first step extending from the first inner wall, wherein the first step and the first inner wall define a first recess;

a second inner wall extending from the first step in the mounting direction;

a second step extending from the second inner wall, wherein the second inner wall and the second step define a second recess configured to receive a head of the fastener; and a cover member comprising a surface configured to block environmental elements, the cover member also comprising a cover bottom, the cover member being configured so that, when the cover member is coupled to the step-shaped structure:

the cover member fits within the first recess;

the cover bottom is engaged with the first step;

the surface blocks entry of environmental elements into the second recess; and the surface is configured to display a marking.

2. The mounting block member as recited in claim 1, further comprising an arrow rest member comprising an arrow receptacle, the arrow rest member connected to a housing, wherein the mounting block member is directly connected to the housing.

3. The mounting block member as recited in claim 2, further comprising a second fastener that connects the housing to the mounting block member.

4. The mounting block member as recited in claim 2, wherein the aperture comprises a first aperture, and the housing comprises a second aperture and a second fastener disposed within the second aperture.

5. The mounting block member as recited in claim 4, wherein the second aperture is non-circular and elongated along a vertical direction.

6. The mounting block member as recited in claim 5, wherein the first aperture is non-circular and elongated along a horizontal direction, wherein the horizontal direction and the vertical direction are perpendicular.

7. The mounting block member as recited in claim 2, wherein the housing comprises a first portion and a second portion, the second portion configured to be adjusted in a lateral direction relative to the first portion.

8. The mounting block member as recited in claim 2, wherein the arrow rest member is a fall-away arrow rest member.

9. The mounting block member as recited in claim 2, wherein the arrow rest member is a whisker biscuit style arrow rest member.

10. The mounting block member as recited in claim 1, wherein the aperture is elongated along a horizontal direction.

11. The mounting block member as recited in claim 1, wherein the cover member is rectangular with curved corners.

12. The mounting block member as recited in claim 1, wherein the cover member is circular or elliptical.

13. The mounting block member as recited in claim 1, wherein the cover member is attached to the first step with an adhesive.

14. The mounting block member as recited in claim 1, wherein: (a) the top surface and the surface of the cover member are configured to extend in a common plane when the cover member is positioned within the first recess; and (b) the first recess has a first diameter that is greater than a second diameter of the second recess.

15. The mounting block member as recited in claim 1, wherein the surface of the cover member comprises a solid surface without pass-through holes, the solid surface configured to block access to the second recess so as to impede tampering.

16. The mounting block member as recited in claim 1, wherein the cover member comprises a stepped profile.

17. The mounting block member as recited in claim 1, wherein:

the cover member has an area and a perimeter surrounding the area; and the surface of the cover member extends entirely across the area.

18. The mounting block member as recited in claim 17, wherein the cover member is non-elastic.

19. An archery bow comprising:

a bow riser;

a mounting block comprising a step-shaped structure defining an aperture configured to receive a fastener, the step-shaped structure comprising:

a bottom surface configured to face in a mounting direction toward the bow riser;

a top surface;

a first inner wall extending from the top surface in the mounting direction;

a first step extending from the first inner wall, wherein the first step and the first inner wall define a first recess;

a second inner wall extending from the first step in the mounting direction;

a second step extending from the second inner wall, wherein the second inner wall and the second step define a second recess configured to receive a head of the fastener; and a cover member comprising a surface configured to block environmental elements, the cover member also comprising a cover bottom, the cover member being configured so that, when the cover member is coupled to the step-shaped structure:

the cover member fits within the first recess;

the cover bottom is engaged with the first step;

the surface blocks entry of environmental elements into the second recess; and the surface is configured to display a marking.

20. An archery mount comprising:

a structure defining a fastener opening configured to receive a fastener, the structure comprising:

a first step defining a first recess;

a wall extending from the first step in a mounting direction toward an archery bow; and a second step defining a second recess; and a cover configured to fit within the first recess while concealing a fastener inserted into the fastener opening, wherein, when the cover is positioned within the first recess:

the cover is engaged with the second step; and the cover is configured to provide a barrier against an entry of environmental elements into the second recess.

21. The archery mount of claim 20, wherein:

the structure comprises a top surface;

the top surface and the surface of the cover are configured to extend in a common plane when the cover is positioned within the first recess;

the cover comprises an area and a perimeter surrounding the area; and the surface of the cover comprises a solid surface extending entirely across the area without pass-through holes, the solid surface configured to block access to the fastener so as to impede tampering.

* * * * *